US005778795A

United States Patent [19]

Kusel et al.

[11] Patent Number: 5,778,795

[45] Date of Patent: Jul. 14, 1998

[54] RAILWAY TRUCK ASSEMBLY FOR TRUCK MAINTAINENCE

[75] Inventors: Peter Gunter Kusel, Pretoria; Johannes Van Dyk, Essenlen Park, both of South Africa

[73] Assignee: Gobarail (Pty) Limited, Pretoria, South Africa

[21] Appl. No.: 689,063

[22] Filed: Jul. 30, 1996

[30] Foreign Application Priority Data

Jul. 31, 1995 [ZA] South Africa ..... 95/6351
Dec. 27, 1995 [ZA] South Africa ..... 95/10949

[51] Int. Cl.[6] ..... E01B 29/02

[52] U.S. Cl. ..... 104/3; 212/314; 212/325

[58] Field of Search ..... 104/2, 3; 105/3, 105/238.1, 355; 212/314, 325

[56] References Cited

U.S. PATENT DOCUMENTS 2,696,791 12/1954 Boulard ..... 104/3
5,127,335 7/1992 Whitaker, Jr. ..... 104/3

FOREIGN PATENT DOCUMENTS 2313055 9/1974 Germany ..... 104/3
1318624 6/1987 U.S.S.R. ..... 104/3
2104133 3/1983 United Kingdom ..... 104/2

*Primary Examiner*—S. Joseph Morano
*Attorney, Agent, or Firm*—Young & Thompson

[57] ABSTRACT

A railway truck assembly for performing a number of functions of repair, maintenance, replacement and other railway-orientated functions has a pair of trucks joined by one or more longitudinal beams which support hoists; the beam is pivoted for angular horizontal movement to accommodate curves in the track during transit and the beam having a length which spans a working space between the trucks and for the hoists to lift or deposit items or material from either or both trucks and transfer them to or from the working space.

1 Claim, 5 Drawing Sheets

RAILWAY TRUCK ASSEMBLY FOR TRUCK MAINTAINENCE

FIELD OF THE INVENTION

This invention relates to a railway truck assembly which is arranged to perform many functions of repair, maintenance, replacement and other railway orientated functions such as railway panel (including turn-outs) laying or replacing; ballast replacement or addition or removal; formation repair, removal and replacement and, in fact, any function requiring lifting and moving means.

BACKGROUND OF THE INVENTION

It is an object of the invention to provide an assembly which has considerable versatility and which eliminates or at least greatly reduces the amount of heavy manual labor hitherto required for such functions.

Another object of the invention is to reduce the time of occupation of railway track for the carrying out of such functions, to simplify the operations and to reduce accidents and injuries.

A still further object of the invention is to provide an assembly which can be used to perform all these functions while remaining inside a single track structure gauge, thereby avoiding interference on adjacent lines.

It is believed that the present invention, as described herebelow provides great advantages having regard to the prior art.

In German Patent 2 313 055 there is a fixed distance between the tractors. The rails are lifted from the left hand side and then slided between the tractors and then dropped. No provision is made for the tractors to carry equipment and material and they do not travel in tandem on the rail system. No provision for cantilever operation is envisaged.

German Patent 2 928 152 also has a fixed frame between the tractors and relies on lateral movements for removal and replacement of rail panels.

French Patent 2 561 275. The operation of this invention is shown particularly in FIG. 8 in which "N" is a new turn-off and it is slided between a fixed support 4 to a position under the beam 1 and then turned to the top of the beam (see FIGS. 12 and 13). The apparatus then picks up the old turn-out "A" and the beam is swiveled to get "N" below the beam and "A" above the beam.

French Patent 2 296 731. The mechanism used in this patent is virtually the same as in the previous French patent, the only difference being that a truck 1 replaces the platform 6. Otherwise the sequence of events is the same.

French Patent 2 520 158. The trucks are not equipped to carry equipment and material; the beam is not able to form one or two cantilevers; there is no vertical adjustment of the height of the beam 1; and there is no possibility of longitudinal movement of the beam relative to the trucks.

U.S. Pat. No. 2,696,791. Although this invention provides cantilever it does not cater for the spanning of the beam between two trucks and has to rely on a foot or forward support 9.

SUMMARY OF THE INVENTION

According to the invention a railway truck assembly includes a pair of trucks joinable by one or more longitudinal beams adapted to support one or more hoists on either or both the trucks, the beam allowing for angular movement in the horizontal plane for cornering, and having a length to span a working space between the trucks and to be able to hoist or deposit items or material from either or both trucks and transfer them to or from the working space.

In the preferred form of the invention, the horizontal beam comprises two portions which may be joined together or separated. In one form the portions are separated and provide one or more cantilevered beams for certain specialist rail operations. This also has the effect of increasing the possible separation distance between trucks for certain applications.

The beams or joined beams should be capable of longitudinal movement relative to the trucks to increase the versality of the assembly.

In one form of the invention the two portions of the beam may be joined by means of a hook arrangement which is operable by means of a hydraulic ram.

The number of supports in the form of portal frames or gantries on each truck will have to be determined having regard to the maximum length of the cantilever and the load which is expected to be involved.

Further according to the invention the supports for the beam are of telescopic configuration so that they can be raised and lowered.

In one form of the invention the beam or beams comprises a pair of longitudinal I beams with a web therebetween. The hoists preferably are able to move along the whole length of the I-beam/s.

The beams may be laterally displaced, effectively pivoting at a substantially central position on each truck, and are angularly associated with other supports so that the beams can contend with curves in the railway track during movement, when joined or when only one beam is provided between the trucks.

The assembly should also provide for vertical displacements.

The trucks for use in the invention are preferably flat bottom trucks and one or both of them may have tip or drop sides to container material falling from the trucks.

BRIEF DESCRIPTION OF THE DRAWINGS

Embodiments of the invention are described below with reference to the accompanying drawings, in which.

DESCRIPTION OF THE PREFERRED EMBODIMENTS

Figure 1:
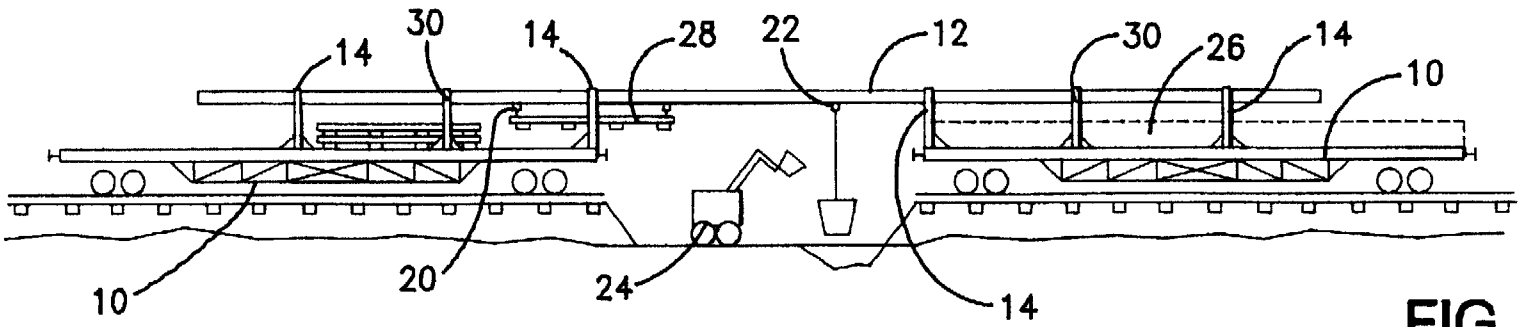
FIG. 1 is a side view of a truck assembly according to the simplest form of the invention.
Figure 2:
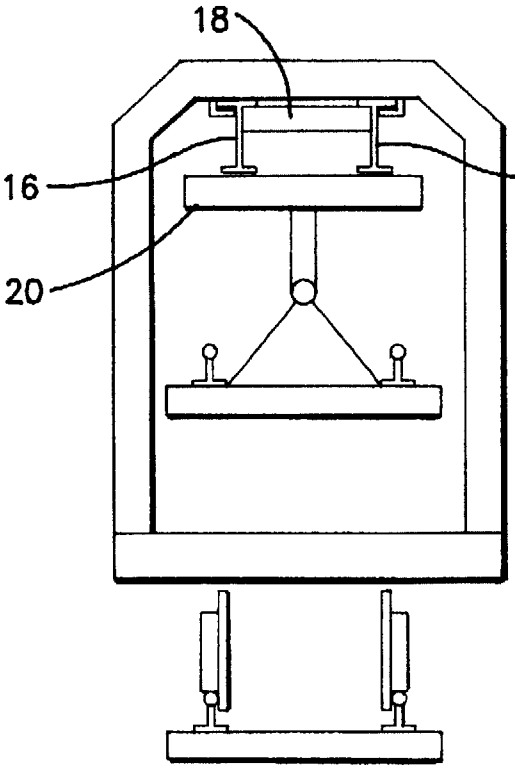
FIG. 2 is an end view of the assembly illustrating the construction of the horizontal beam.

FIG. 1 illustrates an operable position of an assembly of a pair of trucks 1O which have been separated to enable one or more functions to be carried out therebetween.

A longitudinal beam 12 joins the trucks, the beam being slidable with respect to supports 14 so that it spans the gap between the trucks, as shown. The supports 14 comprise a series Of gantries or portal frames 42,44.

The beam comprises a pair of I-beams 16 with a web 18 therebetween and this beam supports a hoist 20 which can transfer a panel 28, or other item from a stored position on one of the trucks, into the gap. Other items include a material hoist 22, a loader 24, turn-outs or the like. A power engine (not shown) is mounted on one of the trucks.

One or both of the trucks may include sides 26 so that it can transport ballast, soil or the like.

The assembly may also be adapted to remove old panels 28, so that the operation or operations can be carried out within the confines of a single track structure gauge, thereby avoiding interferences with traffic on adjacent lines, which is a problem with conventional operations.

In order to provide for angular movement in the longitudinal and vertical planes, the beam may be effectively pivoted on the central support 30 of each truck and adequate movement is provided on the other supports 14.

Figure 3:
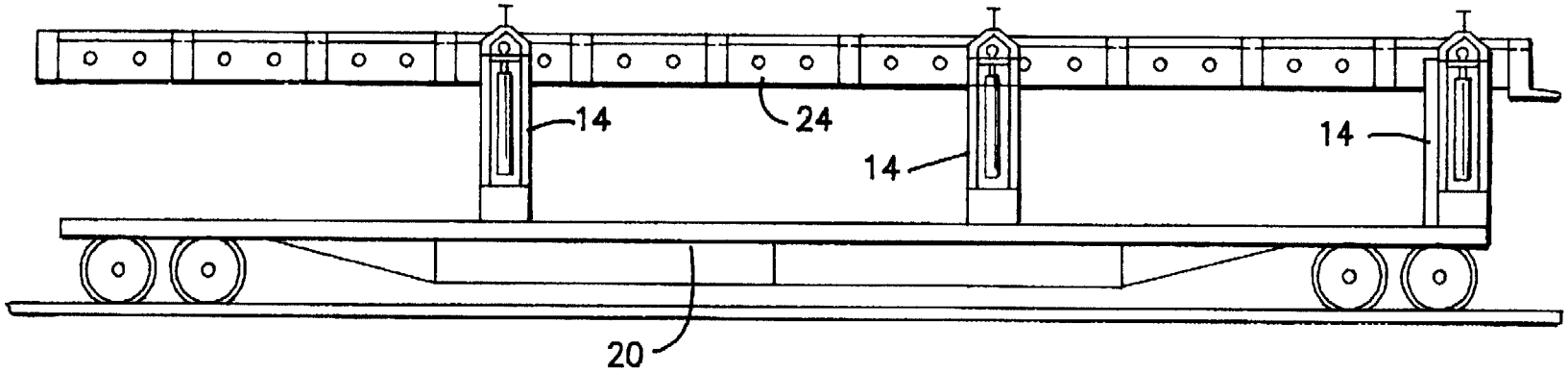
FIG. 3 is a side view of a truck with a beam in travelling position.
Figure 4:
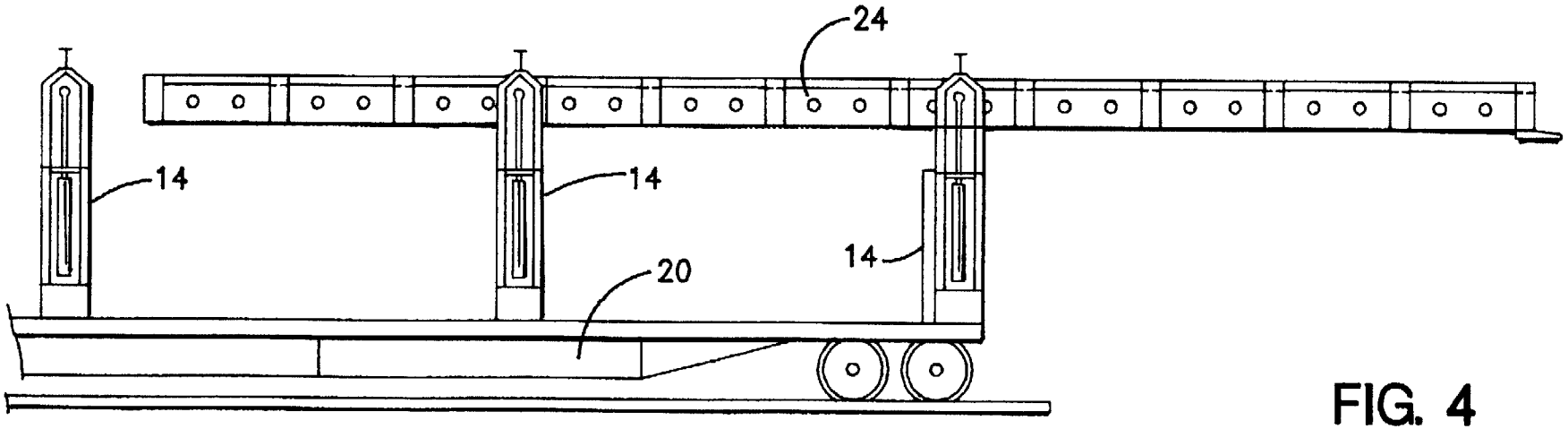
FIG. 4 is a similar view with the beam in extended cantilever position.

Turning now to FIGS. 3 to 9 which illustrate an alternate and preferred form of the invention, in FIG. 3, a low bottom truck 20 has three supports 14 for a beam 24 which is slidable longitudinally in the supports to move, for example, to a position shown in FIG. 4 in which the beam is a cantilever. At the same time the beam is able to swivel with respect to the supports so that, when it is connected to a second portion of the beam ( as discussed below), it is able to accommodate curves during travelling.

Figure 5:
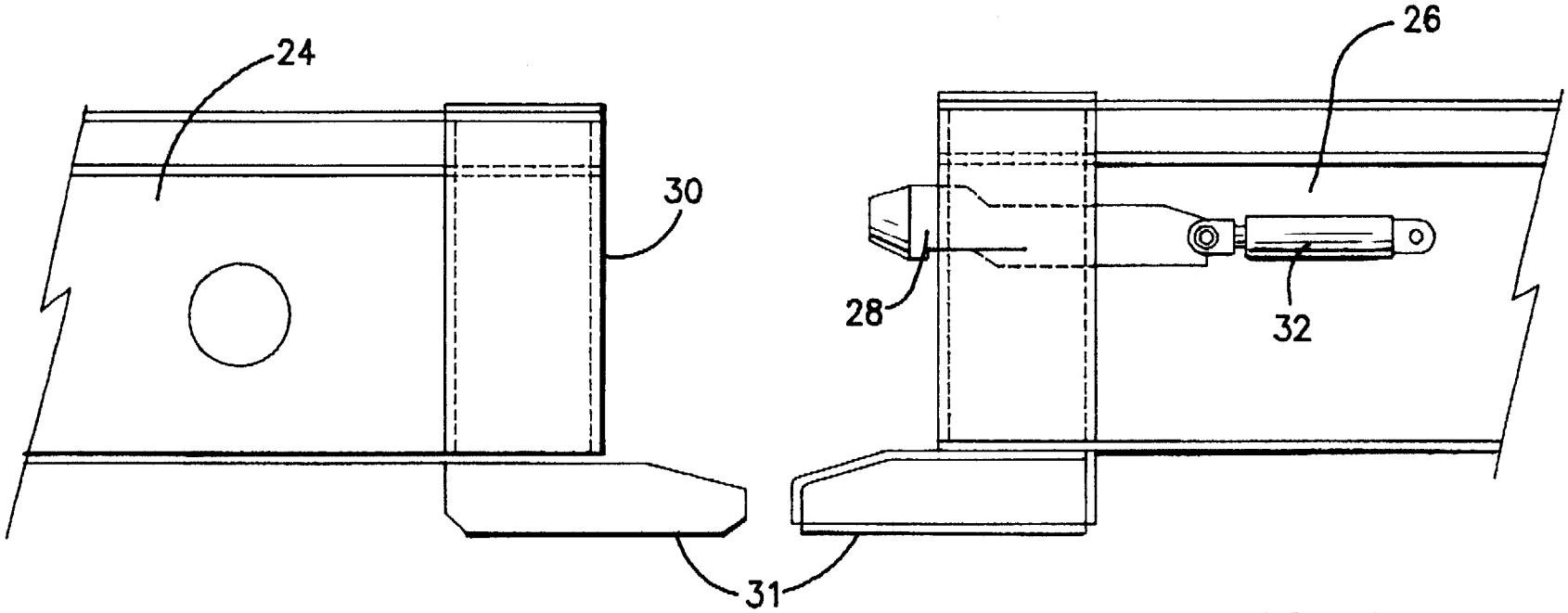
FIG. 5 is an enlarged detail of the linkage for the two portions of the overall beam.

In FIG. 5 the two portions 24,26 of the beam are connectable through a hook formation 28 which engages in an orifice 30, the hooking action being achieved by means of the hydraulic ram 32. The joint is completed by intergaging formations 31, which are of male-female configuration.

It will be appreciated that the provision of two cantilevered portions enables a large span to be worked between two trucks, each carrying a beam (or, more correctly, a portion of the beam).

Figure 6:
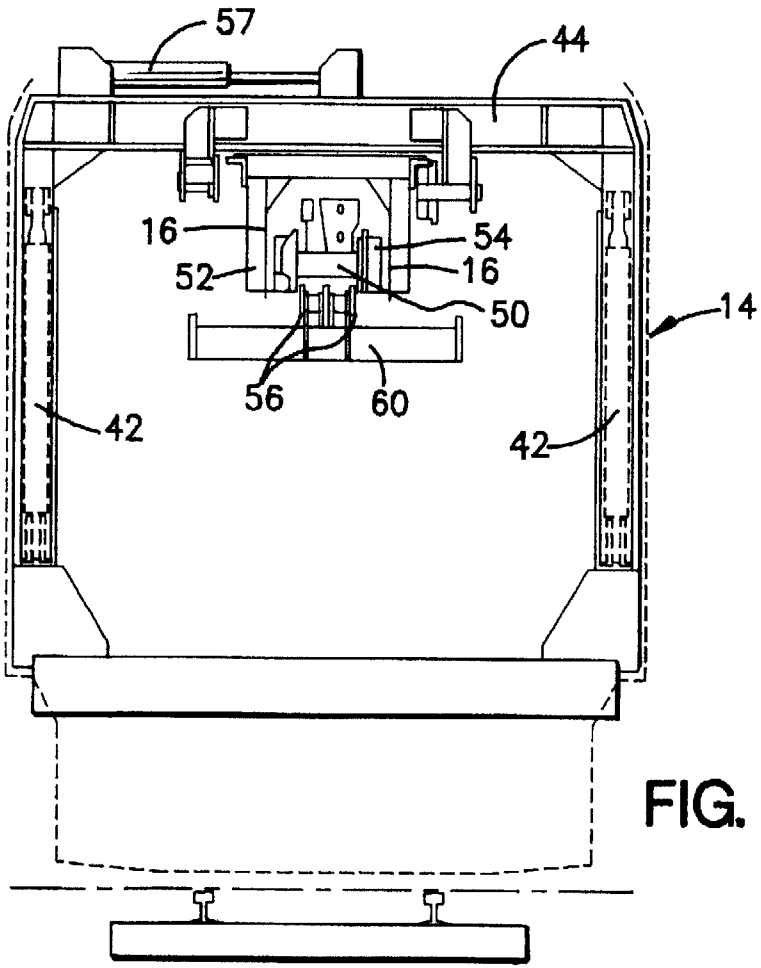
FIG. 6 is an end view of a hoist for use in the invention in a travelling position.

In FIG. 6 a gantry or portal frame 14 is shown in its travelling condition and includes telescoping legs 42 which support a cross member 44.

Figure 7:
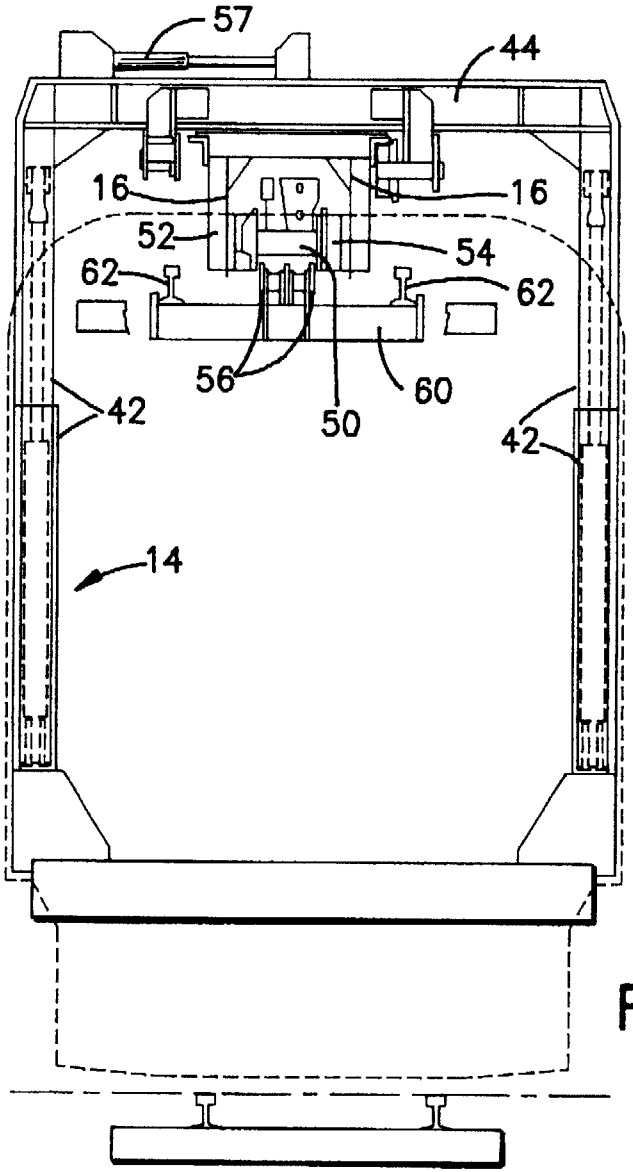
FIG. 7 is a similar view to FIG. 4 of the hoist in an operative position.

A hoist 50 is slung between I beams 16 and brackets 52 are provided for strengthening and runs on wheels 54. Safety hooks 56 are interposed between the hoist and the lifting beam 60. In FIG. 7 the legs 42 are extended and the arrangement is shown in a slewed condition and also shows a rail panel 62 which has either been raised from its position so that it can be replaced by a new panel; or the zone under the panel can be replaced, repaired or maintained while it is held in the raised position. The slewing action is achieved by means of an hydraulic ram 57.

Figure 8:
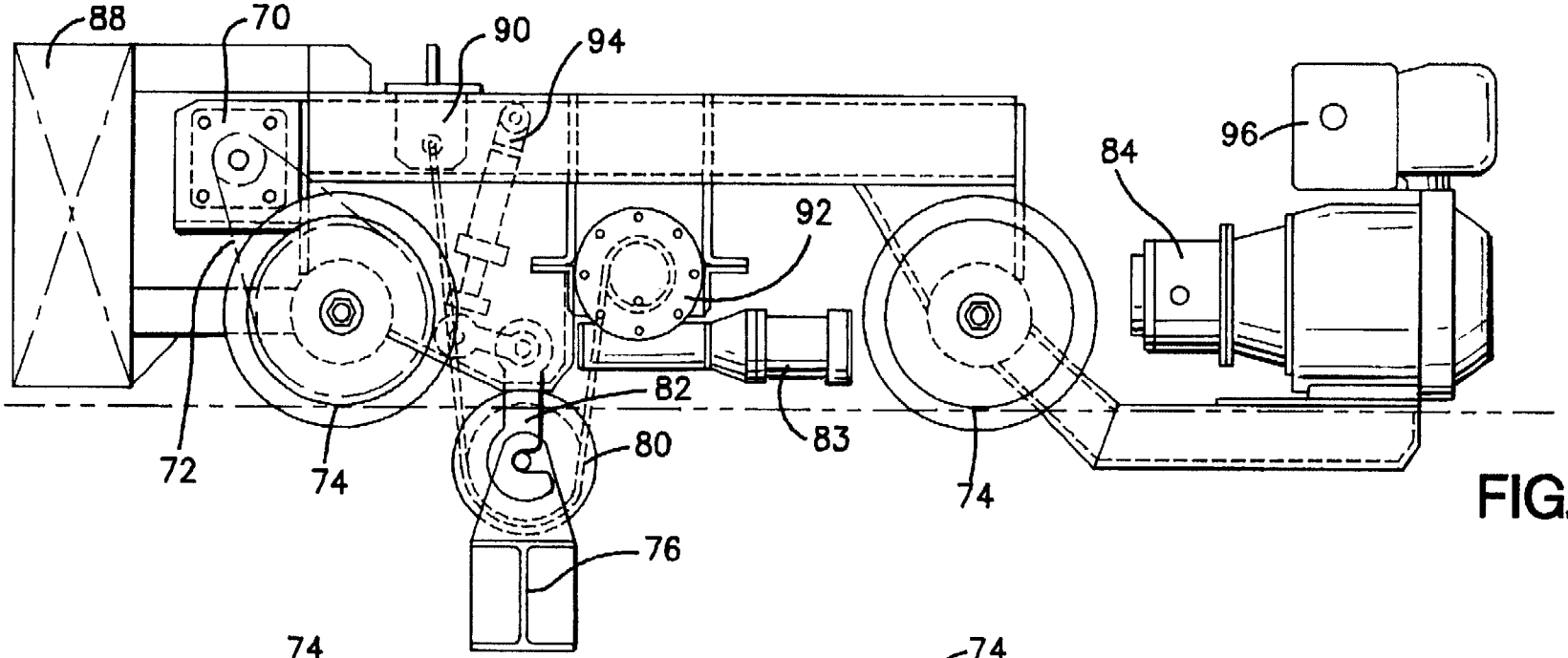
FIG. 8 is a side view of the hoist of FIGS. 4 and 5.
Figure 9:
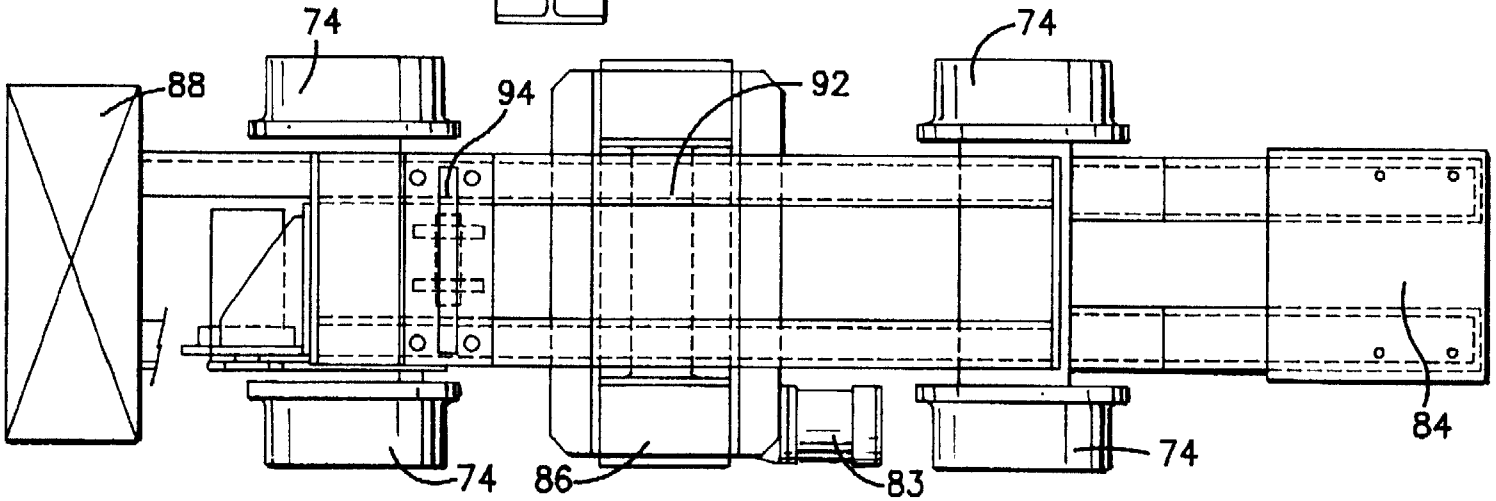
FIG. 9 is a plan view thereof.

Turning now to FIGS. 8 and 9, the hoist comprises a transverse drive motor 70 which, through a chain 72 drives the wheel 74 so that the hoist can be moved longitudinally. The beam 76 is connected to pulley 80 which is engaged by a safety lock 82.

The sheave winch or hydraulic cylinder 80 is rotated by an hydraulic winch 83 supplied by hydraulic fluid from hydraulic pump 84. The drive for the hoist may be self powered or by means of an electrical motor fed by power cables located along the beam to receive and transfer electrical power.

A worm reduction gear 86 is provided to provide the correct rate of movement.

The movement of the beam/s may be achieved in several ways—for example a winch or the like may be provided with chains.

We claim:

1. A railway truck assembly comprising:

first truck and a second truck, each of said trucks having rail wheels;

a first plurality of vertically adjustable supports extending from said first truck, and a second plurality of vertically adjustable supports extending from said second truck;

first beam having a cantilevered first end extending from a first end of said first truck towards said second truck, and a second beam having a cantilevered second end extending from a second end of said second truck towards said first truck, said first beam and said second beam being longitudinally adjustable relative to each other, and said first truck and second truck, respectively;

means for connecting said cantilevered first end to said cantilevered second end; said first plurality of vertically adjustable supports supporting said first beam, and said second plurality of vertically adjustable supports supporting said second beam;

at least one support of said first plurality of vertically adjustable supports comprising first means for pivoting said first beam in a horizontal plane, and at least one support of said second plurality of vertically adjustable supports comprising second means for pivoting said second beam in said horizontal plane; and means for hoisting material from a working space located between said first end of said first truck and said second end of said second truck.

* * * * *

UNITED STATES PATENT AND TRADEMARK OFFICE

CERTIFICATE OF CORRECTION

PATENT NO. : 5,778,795

DATED : July 14, 1998

INVENTOR(S) : Peter Gunter KUSEL et al.

It is certified that error appears in the above-indentified patent and that said Letters Patent is hereby corrected as shown below:

On title page, item [54] and col. 1, lines 1-2,
change "TRUCK MAINTAINENCE" to --TRACK MAINTENANCE--.

Signed and Sealed this

Eighth Day of September, 1998

*Attest:*

Bruce Lehman

BRUCE LEHMAN

*Attesting Officer*

*Commissioner of Patents and Trademarks*